US008950178B2

(12) United States Patent
Miki et al.

(10) Patent No.: US 8,950,178 B2
(45) Date of Patent: Feb. 10, 2015

(54) EXHAUST DEVICE OF MULTI-CYLINDER ENGINE

(71) Applicant: Honda Motor Co., Ltd., Tokyo (JP)

(72) Inventors: Sosuke Miki, Wako (JP); Takuya Otsuka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 14/156,859

(22) Filed: Jan. 16, 2014

(65) Prior Publication Data

US 2014/0290231 A1 Oct. 2, 2014

(30) Foreign Application Priority Data

Mar. 28, 2013 (JP) ..... 2013-069263

(51) Int. Cl.
*F01N 1/00* (2006.01)
*F01N 13/18* (2010.01)

(52) U.S. Cl.
CPC ..... *F01N 13/1805* (2013.01)
USPC ..... 60/323; 60/312; 60/313; 60/322; 60/324

(58) Field of Classification Search
USPC ..... 60/272, 287, 305, 312, 313, 314, 322, 60/323, 324
See application file for complete search history.

(56) References Cited

U.S. PATENT DOCUMENTS

| | | | | | |
|---|---|---|---|---|---|
| 3,994,270 | A * | 11/1976 | Nakano et al. | 123/255 |
| 4,745,742 | A * | 5/1988 | Nada et al. | 60/276 |
| 4,831,823 | A * | 5/1989 | Ueda | 60/313 |
| 5,148,597 | A * | 9/1992 | Weeks | 29/890.08 |
| 5,365,735 | A * | 11/1994 | Weber et al. | 60/323 |
| 6,018,946 | A * | 2/2000 | Matsumoto | 60/323 |
| 8,127,540 | B2 * | 3/2012 | Harada | 60/324 |

FOREIGN PATENT DOCUMENTS

| | | | |
|---|---|---|---|
| JP | 2004-92622 | A | 3/2004 |
| JP | 4653064 | B2 | 3/2011 |

* cited by examiner

*Primary Examiner* — Binh Q Tran
(74) *Attorney, Agent, or Firm* — Birch, Stewart, Kolasch & Birch, LLP

(57) ABSTRACT

An exhaust device for a multi-cylinder engine for connecting both exhaust passage members with a communicating hole formed in each one when the two exhaust passage members are to be spaced apart. A base plate has a through hole communicating with the communicating hole and a cover plate for covering the outside of the base plate. The outer circumferential area of the through hole of the base plate overlaps the outer surface of the exhaust pipe with the entire outer circumferential area of the through hole is welded to the exhaust pipe. The edge portions on both sides of the cover plate are welded to the base plate so as to surround the outer side of the through hole. The area extending between edge portions on both sides of the cover plate is welded to the front and rear edge portions of the base plate.

20 Claims, 7 Drawing Sheets

EXHAUST DEVICE OF MULTI-CYLINDER ENGINE

CROSS-REFERENCE TO RELATED APPLICATIONS

The present application claims priority under 35 USC 119 to Japanese Patent Application No. 2013-069263 filed Mar. 28, 2013 the entire contents of which are hereby incorporated by reference.

BACKGROUND OF THE INVENTION

1. Field of the Invention

The present invention relates to an exhaust device for a multi-cylinder engine having a plurality of exhaust passage members which are connected to each of the cylinders of the engine.

2. Description of Background Art

A vehicle such as a motorcycle equipped with a multi-cylinder engine is provided with an exhaust device in which a plurality of exhaust passage members (exhaust pipes and exhaust mufflers) extend from each of cylinders of an engine.

The exhaust device of this type is known wherein an exhaust device allows the intermediate portions extending in the direction of any two of exhaust passage members to communicate with each other for the purpose of improving the engine power output and the like. See, for example, Japanese Patent Publication No. 4653064 and Japanese Laid-open Patent Publication No. 2004-92622.

An exhaust device according to Japanese Patent Publication No. 4653064 is configured such that a communicating hole is provided in each of intermediate portions in the extending direction of the two exhaust pipes (exhaust passage members), which are disposed so as to be adjacent to each other. Peripheral walls of the intermediate portions of each of the exhaust pipes are fixed with each other by welding with a plate-like joint member being fixed by welding so as to straddle both exhaust pipes in such a manner that the communicating holes of one exhaust pipe and the other exhaust pipe communicate with each other. The exhaust device according to Japanese Patent Publication No. 4653064 is configured with the communicating portion jointing two exhaust pipes by the portion in which the peripheral walls of two exhaust pipes are jointed with each other and by the plate-like joint member.

In addition, an exhaust device according to Japanese Laid-open Patent Publication No. 2004-92622 is configured such that a communicating hole is provided in each of intermediate portions in the extending direction of two exhaust mufflers (exhaust passage members) with the communicating holes being jointed with each other so as to communicate by a box-like communicating component which is made up of two plate members. As for the exhaust device, one plate member is fixed by welding on the side surface on the side of both exhaust mufflers which are in close proximity to each other, and the other plate member is fixed by welding respectively to the area surrounding the outside of each of the communicating hole of both exhaust mufflers and to the front and rear edge portions of the one plate member.

However, the exhaust device according to Japanese Patent Publication No. 4653064 can be applied only to the case in which two exhaust passage members are disposed so as to be adjacent to each other, but cannot be applied to the case in which two exhaust passage members are disposed to be spaced apart.

In addition, the exhaust device according to Japanese Laid-open Patent Publication No. 2004-92622 can be applied to the case in which two exhaust passage members are disposed to be spaced apart. However, edge portions on both sides of one plate member are fixed by welding to the side surface of the side on which the exhaust passage members are in close proximity to each other. Then, the other plate member needs to be fixed by welding to the outer area of the communicating holes of both exhaust passage members and the front and rear edge portions of one plate member. It is difficult to weld one plate member on the side surface of the exhaust passage member. In addition, it is necessary to weld on the exhaust passage members from front and rear sides in some cases.

SUMMARY AND OBJECTS OF THE INVENTION

It is an object of an embodiment of the present invention to provide an exhaust device for a multi-cylinder engine which can connect both exhaust passage members so as to communicate without requiring a complicated operation in the case where two exhaust passage members are disposed to be spaced apart.

To solve the above-mentioned problem, according to an embodiment of the present invention, the configuration described below is adopted for an exhaust device for a multi-cylinder engine.

According to an embodiment of the present invention, an exhaust device for a multi-cylinder engine includes a communicating hole (17) provided in each of two exhaust passage members (14) disposed to be spaced apart and the communicating holes (17) of the two exhaust passage members (14) are jointed with each other so as to communicate. The exhaust device for the multi-cylinder engine has a base plate member (18) which has a through hole (20) communicating with each of the communicating holes (17) of the two exhaust passage members (14) and in which the entire outer circumferential area of each of the through holes (20) is fixedly attached to the exhaust passage member (14) in such a state that the outer circumferential area of each of the through holes (20) overlaps the outer surface of the corresponding exhaust passage member (14). A cover plate member (19) is provided in which edge portions (19*c*) on both sides are fixedly attached to at least either one of the base plate member (18) or the exhaust passage member (14) so as to surround the outer side of each of the through holes (20) of the base plate member (18) and the areas (19*a*, 19*b*) extending between the edge portions (19*c*) on both sides that are fixedly attached to the front and rear edge portions of the base plate member (18) between the two exhaust passage members (14).

According to an embodiment of the present invention, the outer circumferential area of the through hole (20) of the base plate member (18) is fixedly attached so as to overlap the outer surface of the corresponding exhaust passage member (14), which thereby can easily attach the base plate member to each of the exhaust passage members (14). In addition, the cover plate member (19) is fixedly attached to at least either one of the base plate member (18) or the exhaust passage members (14) in such a way that the edge portions (19*c*) on both sides surround each of the through holes (20), and the area extending between the edge portions on both sides of the cover plate member is fixedly attached to the front and rear edge portions of the base plate member (18) between two exhaust passage members (14), which thereby can facilitate the workability in fixedly attaching the base plate member (18) and the cover plate member (19) from the same direction.

According to an embodiment of the present invention, the base plate member (18) is configured such that the entire area of the inner circumferential portion of the through hole (20) is fixedly attached to the outer surface of the exhaust passage member (14).

According to an embodiment of the present invention, it is possible to easily attach the base plate member (18) to the exhaust passage member (14) only by fixedly attach the entire area of the inner circumferential portion of each of the through holes (20) on the outer surface of the exhaust passage member (14).

According to an embodiment of the present invention, the cover plate member (19) is fixedly attached only to the base plate member (18).

According to an embodiment of the present invention, the surface on the side to be fixedly attached becomes the common component, which thereby can facilitate the workability in fixedly attaching the cover plate member (19).

According to an embodiment of the present invention, the entire area of the outer circumferential portion of the cover plate member (19) is formed so as to be adjusted according to the outer outlined shape of the base plate member (18), the entire area of the outer circumferential portion is fixedly attached so as to overlap the outside edge portion of the base plate member (18).

According to an embodiment of the present invention, it is possible to facilitate the workability in fixedly attaching in such a state that the entire area of the outer circumferential portion of the cover plate member (19) comes into close contact with the outer circumferential portion of the base plate member (18).

According to an embodiment of the present invention, the cover plate member (19) is in such a convex shape that the area from the outer circumferential portion to the center portion side swells outside.

According to an embodiment of the present invention, the cross-sectional area of the passage between the base plate member (18) and the cover plate member (19) is widely secured, which thereby can increase the circulation amount of exhaust gas.

According to an embodiment of the present invention, the base plate member (18) is configured such that the area extending between the two exhaust passage members (14) is formed so as to be recessed in a concave shape relative to the portion which is fixedly attached to the exhaust passage member (14).

According to an embodiment of the present invention, the cross-sectional area of the passage between the base plate member (18) and the cover plate member (19) is widely secured, which thereby can increase the circulation amount of exhaust gas between the exhaust passage members (14).

According to an embodiment of the present invention, the area extending between the two exhaust passage members (14) of the base plate member (18) is formed in a flat surface.

According to an embodiment of the present invention, the area extending between two exhaust passage members (14) of the base plate member (18) is formed entirely in a flat surface, although it is recessed in a concave shape relative to the portion which is fixedly attached to the exhaust passage portion (14). Accordingly, it is possible to facilitate the workability in fixedly attaching, compared to the case in which the fixedly-attached surface with the cover plate member (19) of the area bends or is curved. For example, it is possible to easily insert a welding tool such as welding guns when the base plate member (18) and the cover plate member (19) are welded in the area.

According to an embodiment of the present invention, the exhaust device has a plurality of the cylindrical exhaust pipes (14) extending from a cylinder block (12) of the engine, in which any two of the exhaust pipes (14) constitute the exhaust passage member; the communicating holes (17) are provided in the two exhaust pipes (14) and each of the communicating holes (17) of the two exhaust pipes (14) is disposed on one side with reference to the virtual flat surface passing the axis centers of the two exhaust pipes (14).

According to an embodiment of the present invention, even in a large-size exhaust device with a plurality of exhaust pipes (14), it is possible to easily attach the base plate member (18) and the cross plate member (19) from one direction without turning back the front and back sides relative to any two of exhaust pipes (14).

According to an embodiment of the present invention, the outer circumferential area of the through hole of the base plate member is fixedly attached so as to overlap the outer surface of the corresponding exhaust passage member, and the edge portions on both sides of the cover plate member are fixedly attached to at least either one of the base plate member or the exhaust passage member so as to surround the through hole of the base plate member. At the same time, the area extending between the edge portions on both sides of the cover plate member is fixedly attached to the front and rear edge portions of the base plate member between two exhaust passage members. Consequently, it is possible to connect both exhaust passage members with each other so as to communicate without requiring complicated operation in case where two exhaust passage members are disposed to be spaced apart.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
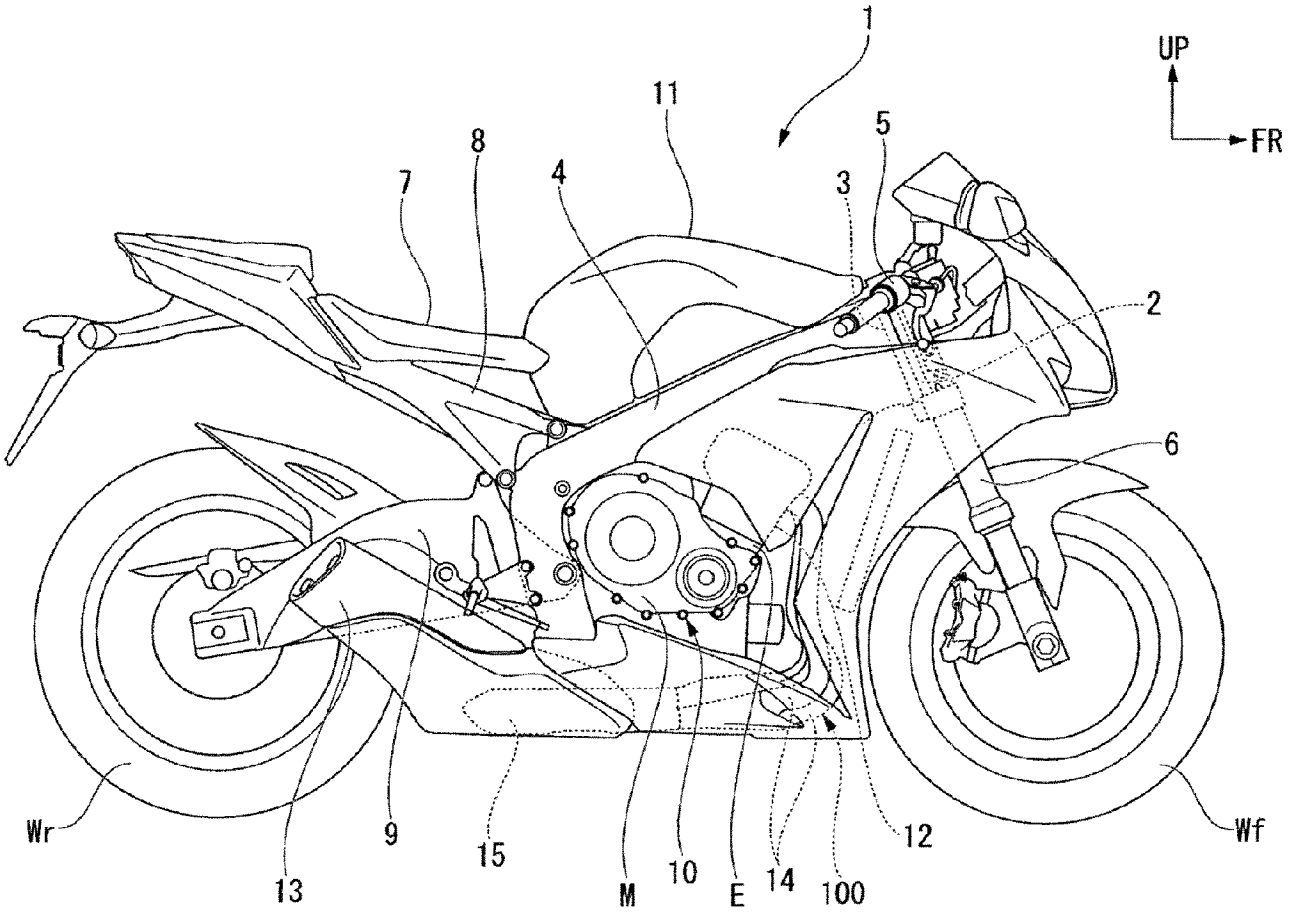
FIG. 1 is a side view of a motorcycle applying an exhaust device according to an embodiment of the present invention.

Hereinafter, the embodiment of the present invention will be described with reference to the drawings. In the drawings, an arrow FR shows the front, an arrow UP shows the upper, and an arrow LH shows the left side of the vehicle.

Figure 2:
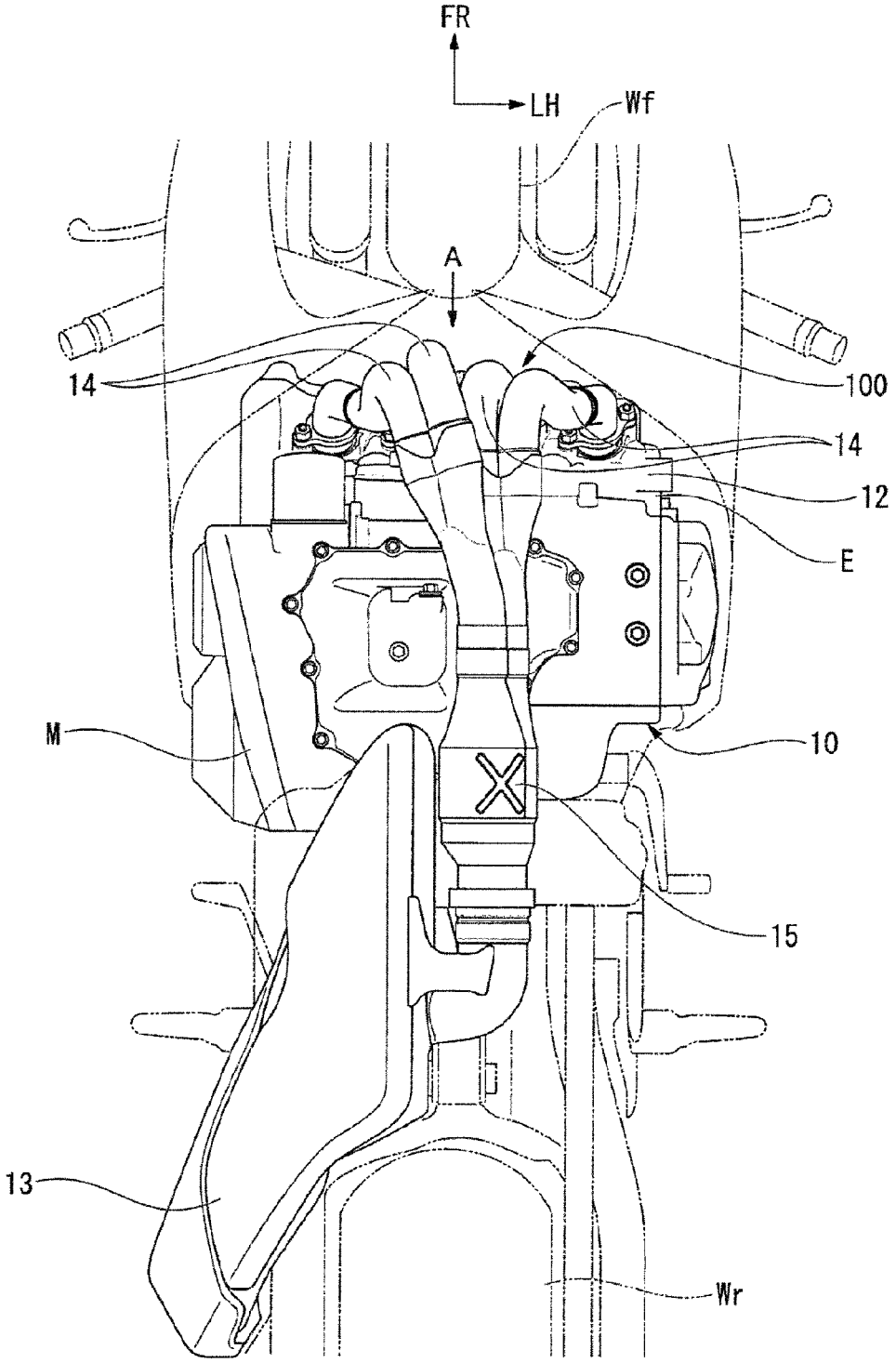
FIG. 2 is a bottom surface view of the motorcycle according to an embodiment of the present invention.

FIG. 1 is a view of a motorcycle 1 applying an exhaust device 100 according to an embodiment of the present invention. FIG. 2 is a view of the bottom surface with a central focus on the exhaust device 100 of the motorcycle 1.

In the motorcycle 1, a pair of left and right main frames 4, which extend from a head pipe 3 downwardly to the rear portion of the vehicle, and a down frame (not shown), which extends downwardly from the head pipe 3, are jointed to the head pipe 3 which rotatably holds a steering shaft 2.

A handlebar 5 for steering and a pair of front forks 6, which rotatably support a front wheel Wf, are connected to the steering shaft 2 via upper and lower bridge members (not shown). The rear portions of a pair of main frames 4 bend downwardly with seat rails 8 supporting a seat 7 being connected to the bending area of the main frames. In addition, a swing arm 9, which extends to the rear side of the vehicle, is swingably supported on the area which extends downwardly from the bending area of the main frames 4. A rear wheel Wr is rotatably supported on the rear portion of the swing arm 9. On the other hand, an engine unit 10, in which an engine E and a transmission M are constituted as an integrated block, is attached on the front side of the bending portion of the main frames 4. A fuel tank 11 is attached on the upper side of the main frames 4. The output shaft of the transmission M is linked via a chain (not shown) with a rear wheel Wr for transmitting power.

An intake system (not shown) including an air cleaner, as well as the exhaust device 100 including an exhaust muffler 13 are jointed to a cylinder block 12 of the engine E. The engine E of the motorcycle 1 is a four-cylinder engine with four intake pipes (not shown) and four exhaust pipes 14 being jointed to the cylinder block 12.

Figure 3:
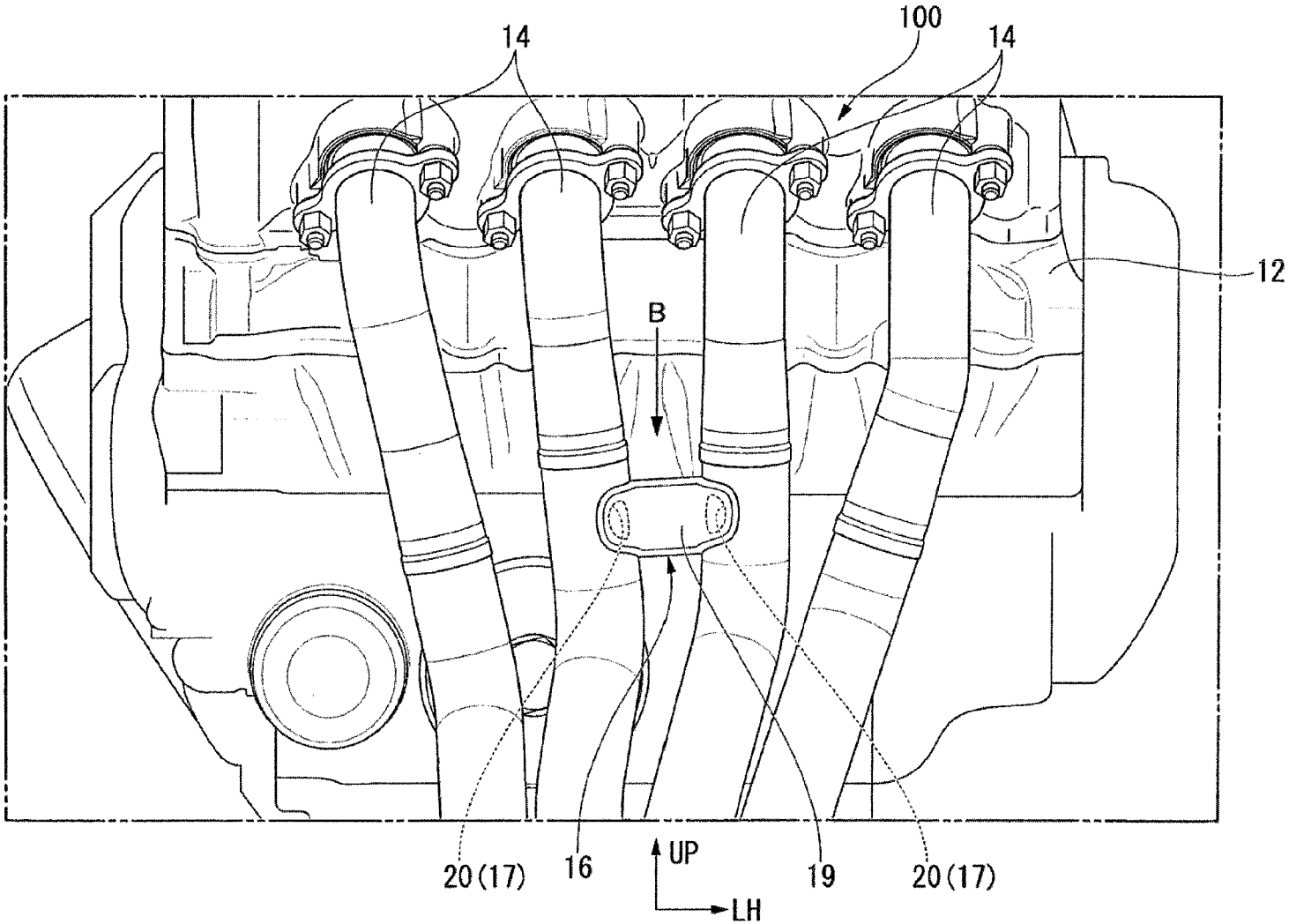
FIG. 3 is a view taken in the direction shown by an arrow A of FIG. 2 according to an embodiment of the present invention.
Figure 4:
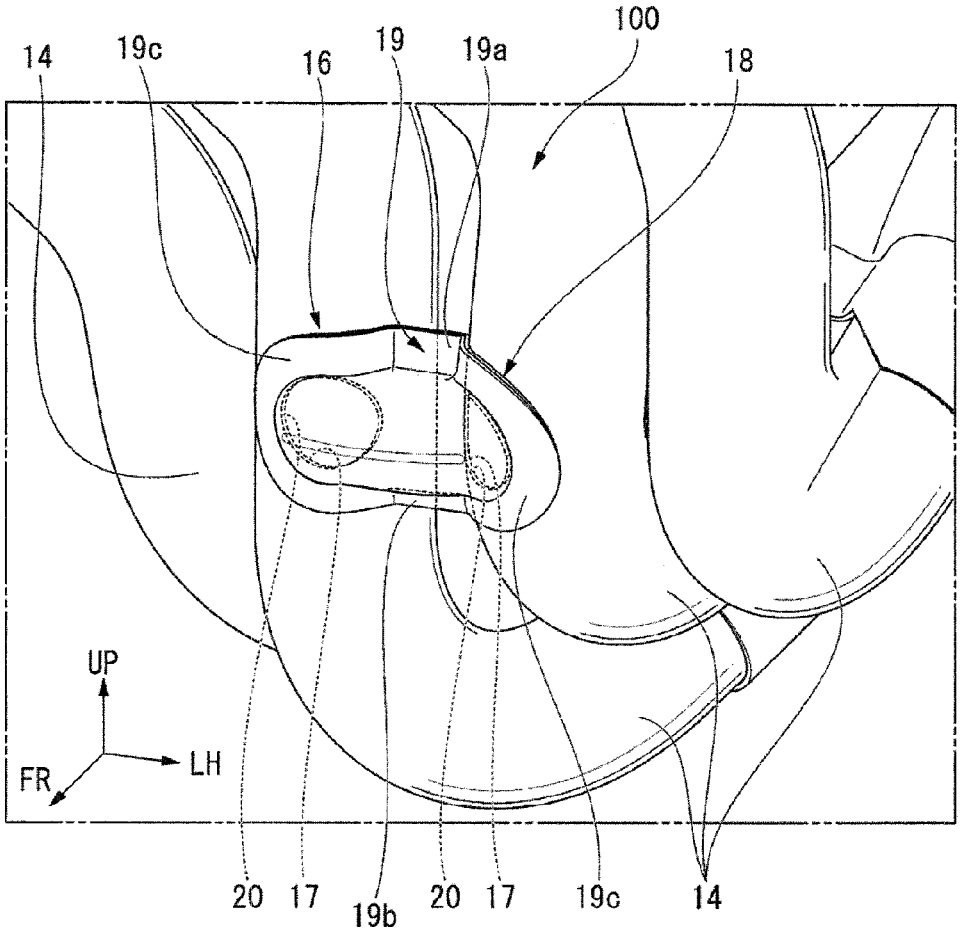
FIG. 4 is a perspective view showing the exhaust device according to the embodiment of the present invention from frontward and upward direction.

FIG. 3 is a view showing the exhaust device 100 from the front side of the vehicle, and FIG. 4 is a view showing a part of the exhaust device 100 from a forward and upward direction.

As shown in FIGS. 2 to 4, the exhaust device 100 has four exhaust pipes 14 which bend downwardly from the front surface of the upper portion of the cylinder block 12 (cylinder head) and then bend and extend further toward the rear side of the vehicle body. A catalyst piping 15 is provided in which the four exhaust pipes 14 meet and are jointed as two collective pipes below the engine unit 10 and then meet and are jointed further as one collective pipe. A catalyst is provided for purifying exhaust gas together with the exhaust muffler 13 which is jointed to the catalyst piping 15 for muffling noise and emitting the exhaust gas to the outside. As shown in FIG. 2, the end portions on the downstream side of four exhaust pipes meet so as to be substantially perpendicular to the center in the width direction of the vehicle and are jointed to the catalyst piping 15 below the engine unit 10. The catalyst piping 15 is disposed so as to be substantially perpendicular to the center in the width direction of the vehicle. The exhaust muffler 13, which is jointed to the catalyst piping 15, extends obliquely upwardly toward the rear portion from the right side portion of the vehicle body.

As shown in FIGS. 3 and 4, four exhaust pipes 14 which extend downwardly from the front surface of the upper portion of the cylinder block 12, are disposed in such a state that the adjacent exhaust pipes 14 are spaced apart from each other. The area out of the exhaust pipe 14, in which the exhaust pipe extends downwardly from the cylinder block 12 and bends to the rear side of the vehicle body, is called the downward-extending area. The communicating component 16, which allows the internal passages of both exhaust pipes 14 to communicate at the intermediate portions of the exhaust pipes 14, is connected to the downward-extending area of two exhaust pipes 14 which are in the vicinity of the center in the width direction of the vehicle. The communicating component 16 can smoothly discharge the exhaust gas by allowing two exhaust pipes 14 to communicate with each other at the intermediate portions thereof, which thereby improves the engine power output.

Figure 5:
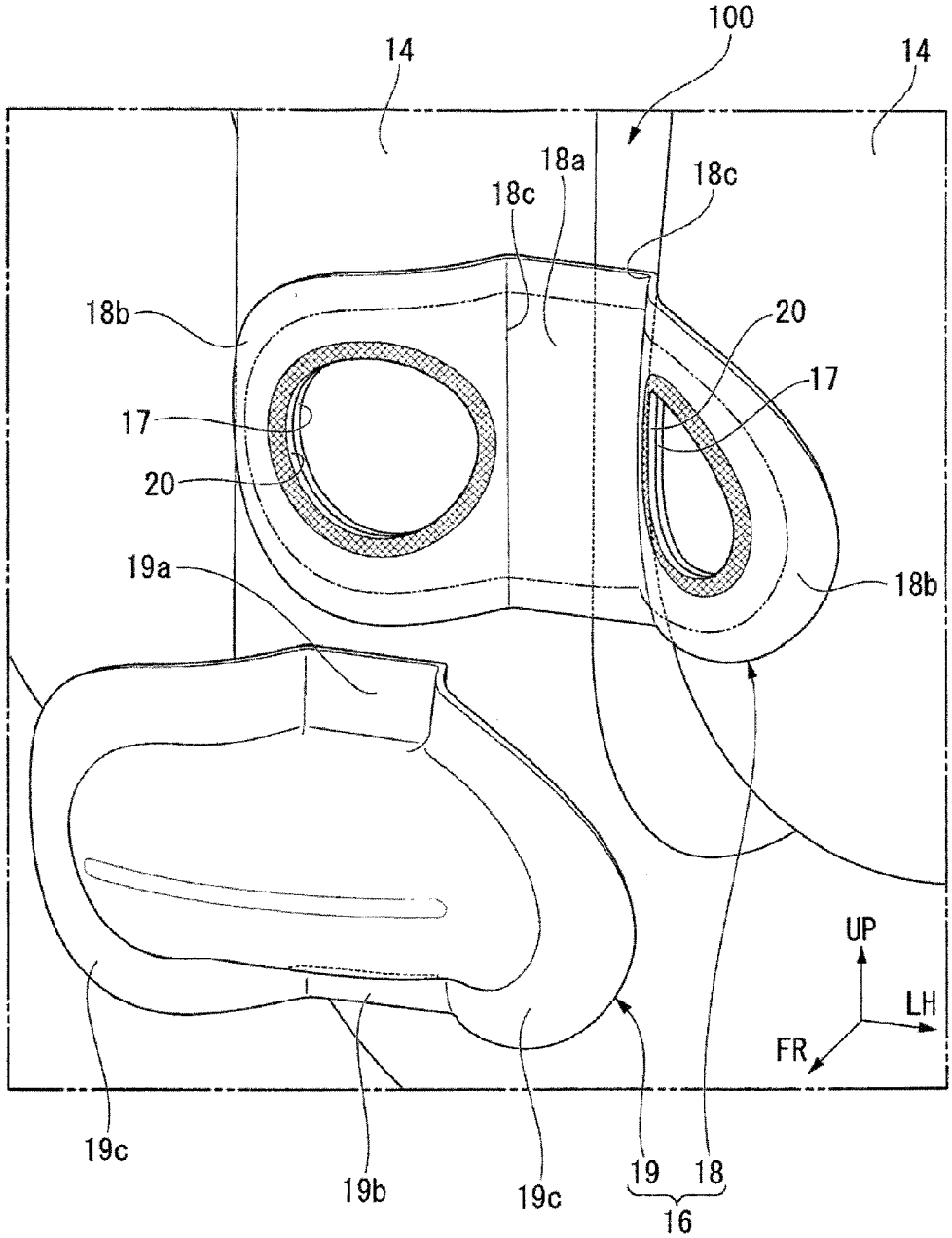
FIG. 5 is an exploded perspective view showing the exhaust device according to the embodiment of the present invention from the direction with reference to FIG. 4.
Figure 6:
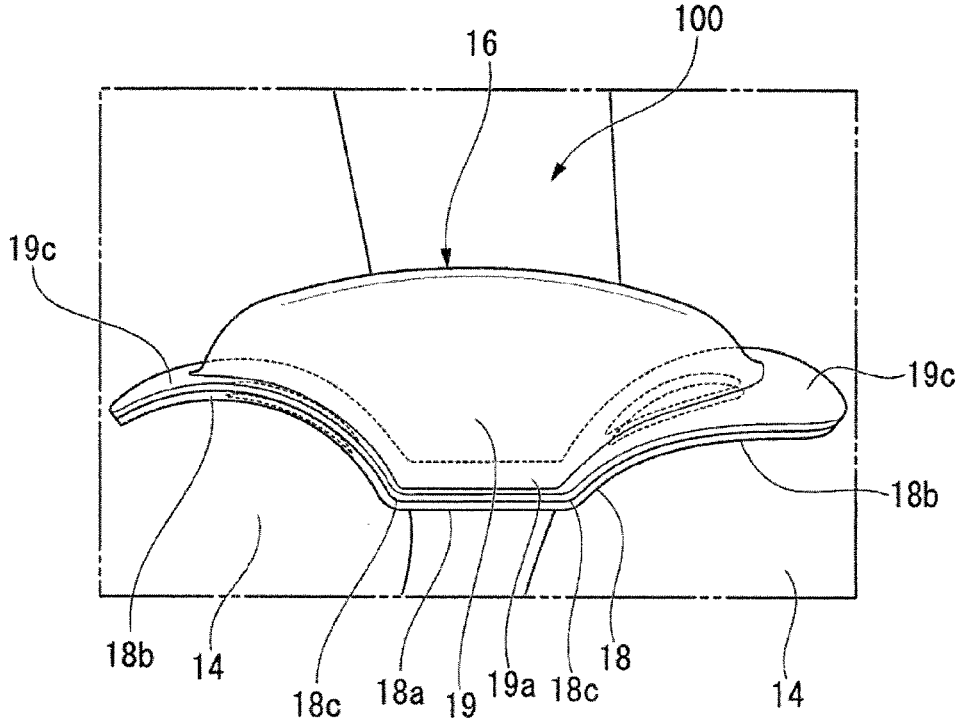
FIG. 6 is a view taken in the direction shown by an arrow B of FIG. 3 according to an embodiment of the present invention.
Figure 7:
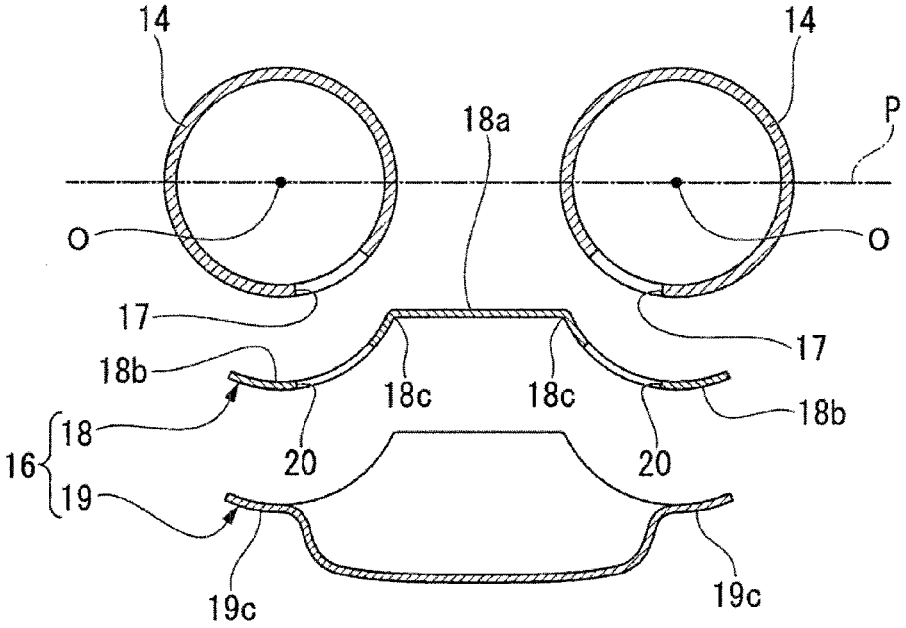
FIG. 7 is an exploded perspective view in which exhaust pipes according to the embodiment of the present invention are sectioned in the direction perpendicular to the axial direction of the exhaust pipes.

FIGS. 5 to 7 are views showing the details of the structure of the communicating component 16.

Communicating holes 17 are formed in the peripheral walls of two exhaust pipes 14 in the center in the width direction of the vehicle with both of the communicating holes 17 communicating with the internal passage of the communicating component 16. The communicating holes 17 of two exhaust pipes are formed in the front side of the vehicle, out of the areas in which both exhaust pipes 14 are opposite to each other. More specifically, as shown in FIG. 7, the communicating holes 17, which are formed in both exhaust pipes 14, are disposed on the front side (one side) of the vehicle with reference to a virtual surface P passing axis centers O, O of both exhaust pipes 14, out of the areas in which both exhaust pipes 14 are opposite to each other. In addition, the communicating holes 17, which are formed in both exhaust pipes 14, may be disposed on the rear side of the vehicle with reference to the virtual flat surface P.

The communicating component 16 has a base plate member 18 which is directly fixed on the outer surface of the peripheral walls of both exhaust pipes 14 and a cover plate member 19 which is attached to the base plate member 18 and forms the internal passage between itself and the base plate member 18. The base plate member 18 and the cover plate member 19 are made of metal plates.

The base plate member 18 includes a band-shaped portion 18*a*, which is flat in a fixed width, and curved piece portions 18*b*, which are provided integrally on both end portions of the band-shaped portion 18*a*, and is formed in a curved shape such that the curved piece portions 18*b* on both sides are perpendicular to the outer circumferential surfaces of the exhaust pipes 14. Linear bending boundary portions 18*c* are provided between the band-shaped portion 18*a* and the curved piece portions 18*b* on both sides of the base plate member 18, respectively. Each of the curved piece portions 18*b* overlaps on the outer surface in the opposite area of each of two exhaust pipes 14 which are disposed in the center and is fixed to the corresponding position of the exhaust pipes 14. In addition, when the curved piece portions 18*b* on both sides are fixed to two exhaust pipes 14, the flat band-shaped portion 18*a*, which extends between two exhaust pipes 14, is recessed in a concave shape relative to the curved piece portions 18 on both sides, which are fixedly attached to the exhaust pipes 14.

In addition, a through hole 20 with the same shape and size as the communicating hole 17 of the corresponding exhaust pipe 14 is formed in the curved piece portions 18*b* on both sides, respectively. Further, each of the curved piece portions 18*b* is configured such that the entire area of the inner circumferential edge portion is fixed by welding on the outer surface of the exhaust pipe 14. Thus, the through hole 20 corresponds with the communicating hole 17 of the corresponding exhaust pipe 14, as shown in FIG. 5 with cross-hatching.

In addition, in the embodiment of the present invention, the curved piece portions 18*b* are fixed by welding to the exhaust pipes 14. Thus, the through hole 20 on the curved piece portions 18*b* side perfectly correspond with the communicating holes 17 on the exhaust pipes 14 side. However, the through holes 20 on the curved piece portions 18*b* side do not always need to perfectly correspond with the communicating holes 17 on the exhaust pipes 14, and they may partially overlap.

The entire area of the outer circumferential portion of the cover plate member 19 is formed so as to be adjusted according to the outer outlined shape of the base plate member 18, and abuts as a surface on the outer circumferential portion of the base plate member 18. More specifically, the cover plate member 19 includes a front edge flange 19*a* and a rear edge flange 19*b*, which abut on the front and rear (front and rear in the extending direction of the exhaust pipe 14) edge portions in the width direction of the band-shaped portion 18*a* of the base plate member 18, and a circumferential flange 19*c* which abuts on the circumferential portions of the curved piece portions 18*b* on both sides of the base plate member 18. In addition, the cover plate member 19 is formed in such a convex shape that the area from the outer circumferential portion to the center portion side swells outside to the direction to be spaced apart from the base plate member 18. The swelling portion forms the internal passage of the communicating component 16 between the base plate member and the cover plate member 19.

The cover plate member 19 is configured such that the entire area of the abutting surface is fixed by welding to the base plate member 18. Thus, the outer circumferential portion of the cover plate member abuts as a surface on the surface of the outer circumferential portion of the base plate member 18. At the same time, the circumferential flanges 19*c* on both sides of the cover plate member 19 are fixed by welding to the circumferential portion of the curved piece portion 18*b* of the base plate member 18 so as to surround the outside of the through holes 20 of the base plate member 18. Thus, the front edge flange 19*a* and the rear edge flange 19*b* of the cover plate member 19 are fixed by welding to the front and rear edge portions of the band-shaped portion 18*a* of the base plate member 18.

The exhaust device 100 according to the embodiment of the present invention is configured such that the communicating component 16, which joints the intermediate portions of two exhaust pipes 14 spaced apart, has the base plate member 18 and the cover plate member 19. The outer circumferential area of the through holes 20 of the base plate member 18 are welded on the outer surface of the intermediate portions of the corresponding exhaust pipes 14 so as to overlap with the circumferential flanges 19*c* on both sides of the cover plate member 19 being fixed by welding to the curved piece portions 18*b* on both sides of the base plate member 18 so as to surround the though holes 20. The front edge flange 19*a* and the rear edge flange 19*b* of the cover plate member 19 are fixed by welding to the front and rear edge portions of the band-shaped portion 18*a* of the base plate member 18. Accordingly, it is possible to easily attach the communicating component 16 to the intermediate portions of two exhaust pipes 14 which are disposed to be spaced apart.

More specifically, when the base plate member 18 is attached to the intermediate portions of both exhaust pipes 14, the through holes 20 of the curved piece portions 18*b* on both sides of the base plate member 18 are positioned so as to correspond with the corresponding communicating holes 17 and the curved piece portions 18*b* overlap the outer surface of the intermediate portions of the corresponding exhaust pipe 14. Thus, the entire area of the circumferential portion of each of the through holes 20 is fixed by welding to the circumferential portion of the communicating hole 17. Thus, it is possible to easily fix by welding the cover plate member 18 to both exhaust pipes 14 under stable condition.

In addition, when the cover plate member 19 is attached, each of the circumferential flanges 19*c* on both sides is fixed by welding to each of the curved piece portions 18*b* of the base plate member 18 such that each of the edge portions on both sides of the cover plate member 19 surrounds the circumferential area of each of the through holes 20 of the base cover plate 18. The area extending between the edge portions on both sides of the cover plate member 19 is fixed by welding to the front and rear edge portions of the band-shaped portion 18*a* of the base plate member 18 with the front edge flange 19*a* and the rear edge portion 19*b*. Therefore, it is possible to easily fix by welding the cover plate member 19 to the base plate member 18 from the same direction. More specifically, it is not necessary to turn back the front and back sides of the entire exhaust device 100 when welding the cover plate member 19.

Figure 8:
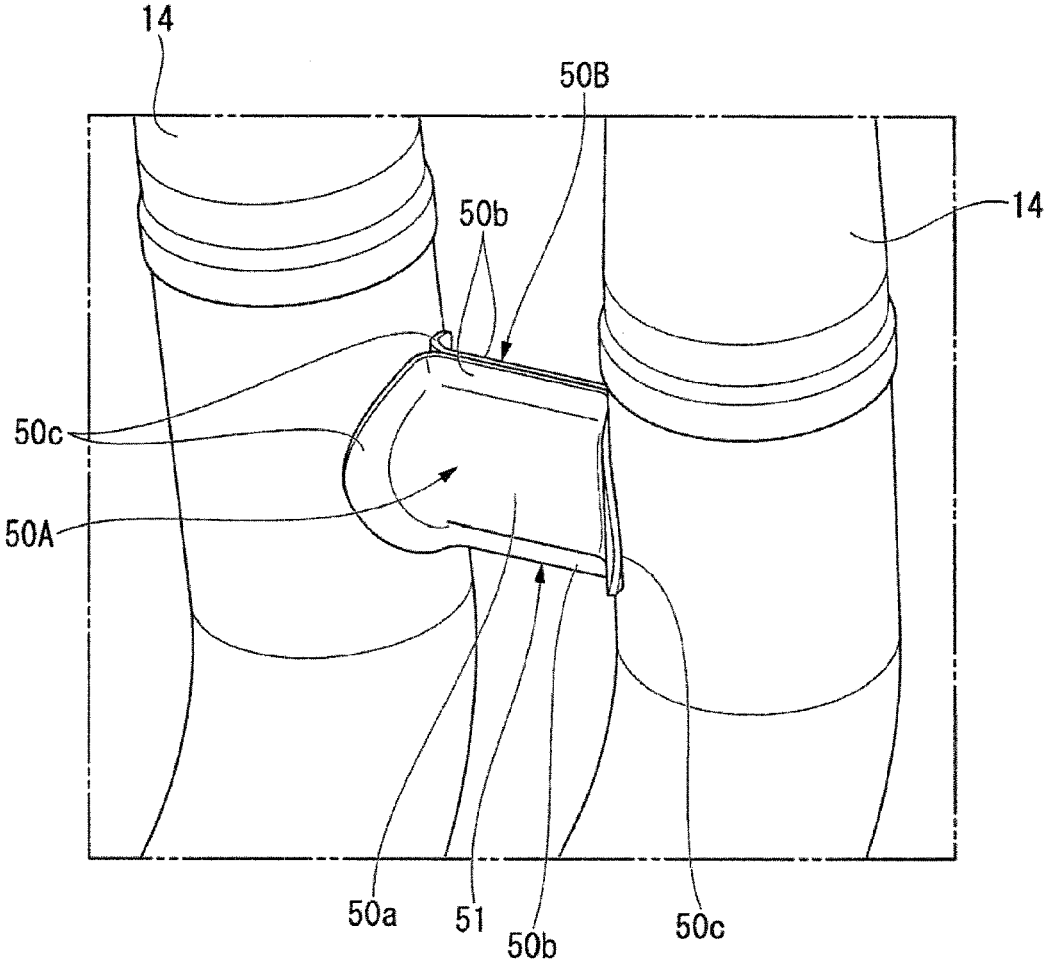
FIG. 8 is a perspective view of the reference example substantially corresponding to FIG. 4.

FIG. 8 is a view showing a reference example for explaining that it is possible to facilitate the workability in fixing by welding when the structure of the exhaust device according to the embodiment of the present invention is adopted.

An exhaust device for the reference example is configured such that a communicating hole (not shown) is provided in two exhaust pipes 14, which are disposed so as to be spaced apart, respectively as with the above embodiment of the present invention, and the communicating holes of both exhaust pipes 14 are connected so as to communicate via a communicating component 51 which has a first plate member 50A and a second plate member 50B. The first plate member 50A and the second plate member 50B are formed in the same shape. Each of the plate members is configured such that the intermediate portion flanges 50*b* are formed integrally with the end portions in the circular arc direction of a semicylinder main body portion 50*a* and end portion flanges 50*c* are formed integrally with both end portions in the axial direction of the main body portion 50*a*.

The communicating component 51 is configured such that the first plate member 50A and the second plate member 50B are fixed by welding with each other between two exhaust pipes 14 by the respective intermediate portion flanges 50*b* with the end portion flanges 50*c* on both sides in the axial direction of both plate members 50A, 50B being fixed by welding on the corresponding outer surface of the exhaust pipes 14 so as to surround the communicating hole respectively. In the reference example, since the welded area is directed to multiple directions, which cannot perform the welding unless the direction of a plurality of exhaust pipes 14 is significantly changed. To the contrary, the exhaust device 100 according to the embodiment of the present invention facilitates the workability in welding without significantly changing the direction of a plurality of exhaust pipes 14.

In addition, it is also possible to fix by welding both edge portions of the cover plate member 19 of the communicating component 16 on the outer surface of the corresponding exhaust pipe 14 in the outer circumferential portion of each of the through holes 20 of the base plate member 18 after fixing by welding the base plate member 18 to the exhaust pipes 14 on both sides, or to fix by welding both edge portions of the cover plate member so as to straddle the outer surface of the corresponding exhaust pipes 14 and the edge portion of the base plate member 18. However, as with the embodiment of the present invention as described, when both edge portions of the cover plate member 19 are fixed by welding only to the base plate member 18, it is only necessary to weld the cover plate member 19 only to one component (the base plate member 18), which further facilitate the workability in fixing by welding.

Further, the exhaust device 100 according to the embodiment of the present invention is configured such that the outside outlined shape of the cover plate member 19 is shaped so as to correspond with the outside outlined shape of the base plate member 18, and the entire area of the outer circumferential portion (the circumferential flanges 19*c*, the front edge flange 19*a*, and the rear edge flange 19*b*) of the cover plate member 19 is fixed by welding so as to overlap the outside edge portion of the base plate portion 18. Accordingly, it is possible to weld the cover plate member 19 so as to stably come into close contact with the entire outer area of the base plate member 18, which thereby further facilitate the workability in welding.

In addition, the exhaust device 100 according to the embodiment of the present invention is configured such that the cover plate member 19 is formed in such a convex shape that the area from the outer circumferential portion to the center portion side thereof swells outside (to the direction to be spaced apart from the base plate member 18). Accordingly, the passage area between the base plate member 18 and the cover plate member 19 is widely secured, which thereby can increase the circulation amount of exhaust gas within the communicating component 16.

The exhaust device 100 according to the embodiment of the present invention is configured such that the band-shaped portion 18*a*, which is the area of the base plate member 18 extending between two exhaust pipes 14, is formed in a concave shape relative to the curved piece portions 18*b* on both sides, which are the portions welded with the exhaust pipes 14. Thus, the passage area between the base plate member 18 and the cover plate member 19 can be further widely secured.

Further, the exhaust device 100 according to the embodiment of the present invention is configured such that the band-shaped portion 18*a* of the base plate member 18 is formed neither in a bending shape nor in a curved shape in the thickness direction, but entirely in a flat surface, which has an advantage to easily weld the front edge flange 19*a* and the rear edge flange 19*b* of the cover plate member 19 on the front and rear edge portions of the band-shaped portion 18*a*, In other words, the band-shaped portion 18*a* is formed entirely in a flat surface, although it is formed to be recessed in a concave shape relative to the curved piece portions 18*b* on both sides. Thus, it is possible to facilitate the workability in welding by inserting a welding tool into the upper area of the band-shaped portion 18*a* and having it aligned along the upper surface of the band-shaped portion 18*a* when welding the base plate member 18 and the cover plate member 19 with a welding tool such as welding guns.

In addition, the exhaust device 100 according to the embodiment of the present invention is a large-size exhaust device with four cylindrical exhaust pipes 14 extending from the cylinder block 12 of the engine. However, as shown in FIG. 7, the exhaust device is configured such that the communicating holes 17 of the two exhaust pipes 14, to which the communicating component 16 are attached, are disposed on one side with reference to the virtual surface P passing the axis centers O, O of the two exhaust pipes 14. The curved piece portions 18*b* of the base plate member 18 are fixed by welding in the circumferential area of each of the communicating holes 17 with the outer circumferential portion of the cover plate member 19 being fixed by welding to the outer circumferential portion of the base plate member 18. As a result, it is possible to easily attach the base plate member 18 and the cover plate member 19 from one direction without turning back the front and back sides of the two exhaust pipes 14.

In addition, the present invention is not limited to the disclosed embodiment. It will be understood by those skilled in the art that various changes in form and detail may be made therein without departing from the spirit and scope of the invention. For example, in the above-mentioned embodiment of the present invention, the intermediate portions of two exhaust pipes are jointed with each other so as to communicate by using the base plate member and the cover plate member. However, the intermediate portions of two exhaust mufflers may be jointed with each other so as to communicate by using the same base plate member and cover plate member as above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. In an exhaust device for a multi-cylinder engine in which a communicating hole is provided in each of two exhaust passage members disposed to be spaced apart and the communicating holes of the two exhaust passage members are jointed with each other so as to communicate, the exhaust device for the multi-cylinder engine comprising:

a base plate member having a through hole communicating with each of the communicating holes of said two exhaust passage members, wherein an entire outer circumferential area of each of said through holes is fixedly attached to said exhaust passage member wherein the outer circumferential area of each of the through holes overlaps the outer surface of the corresponding exhaust passage member;

a cover plate member, wherein edge portions on both sides are fixedly attached to at least either one of said base plate member or said exhaust passage member so as to surround the outer side of each of the through holes of said base plate member; and areas extending between said edge portions on both sides are fixedly attached to the front and rear edge portions of said base plate member between said two exhaust passage members.

2. The exhaust device for the multi-cylinder engine according to claim 1, wherein said base plate member is configured such that the entire area of the inner circumferential portion of said through hole is fixedly attached to the outer surface of said exhaust passage member.

3. The exhaust device for the multi-cylinder engine according to claim 1, wherein said cover plate member is fixedly attached only to said base plate member.

4. The exhaust device for the multi-cylinder engine according to claim 2, wherein said cover plate member is fixedly attached only to said base plate member.

5. The exhaust device for the multi-cylinder engine according to claim 3, wherein the entire area of the outer circumferential portion of said cover plate member is formed to be adjustable according to the outer outlined shape of said base plate member, the entire area of the outer circumferential portion is fixedly attached so as to overlap the outside edge portion of said base plate member.

6. The exhaust device for the multi-cylinder engine according to claim 5, wherein said cover plate member is of a convex shape wherein the area from said outer circumferential portion to the center portion side swells outside.

7. The exhaust device for the multi-cylinder engine according to claim 5, wherein said base plate member is configured such that the area extending between said two exhaust passage members is formed to be recessed in a concave shape relative to the portion which is fixedly attached to said exhaust passage member.

8. The exhaust device for the multi-cylinder engine according to claim 6, wherein said base plate member is configured such that the area extending between said two exhaust passage members is formed to be recessed in a concave shape relative to the portion which is fixedly attached to said exhaust passage member.

9. The exhaust device for the multi-cylinder engine according to claim 7, wherein the area extending between said two exhaust passage members of said base plate member is formed in a flat surface.

10. The exhaust device for the multi-cylinder engine according to claim 3, wherein said exhaust device for the multi-cylinder engine includes:

a plurality of the cylindrical exhaust pipes extending from a cylinder block of the engine with any two of the exhaust pipes constitute said exhaust passage member;

said communicating holes being provided in the two exhaust pipes with each of the communicating holes of the said two exhaust pipes being disposed on one side with reference to the virtual flat surface passing the axis centers of the two exhaust pipes.

11. The exhaust device for the multi-cylinder engine according to claim 5, wherein said exhaust device for the multi-cylinder engine includes:

a plurality of the cylindrical exhaust pipes extending from a cylinder block of the engine with any two of the exhaust pipes constitute said exhaust passage member;

said communicating holes being provided in the two exhaust pipes with each of the communicating holes of the said two exhaust pipes being disposed on one side with reference to the virtual flat surface passing the axis centers of the two exhaust pipes.

12. The exhaust device for the multi-cylinder engine according to claim 6, wherein said exhaust device for the multi-cylinder engine includes:

a plurality of the cylindrical exhaust pipes extending from a cylinder block of the engine with any two of the exhaust pipes constitute said exhaust passage member;

said communicating holes being provided in the two exhaust pipes with each of the communicating holes of the said two exhaust pipes being disposed on one side with reference to the virtual flat surface passing the axis centers of the two exhaust pipes.

13. The exhaust device for the multi-cylinder engine according to claim 7, wherein said exhaust device for the multi-cylinder engine includes:

a plurality of the cylindrical exhaust pipes extending from a cylinder block of the engine with any two of the exhaust pipes constitute said exhaust passage member;

said communicating holes being provided in the two exhaust pipes with each of the communicating holes of the said two exhaust pipes being disposed on one side with reference to the virtual flat surface passing the axis centers of the two exhaust pipes.

14. The exhaust device for the multi-cylinder engine according to claim 9, wherein said exhaust device for the multi-cylinder engine includes:

a plurality of the cylindrical exhaust pipes extending from a cylinder block of the engine with any two of the exhaust pipes constitute said exhaust passage member;

said communicating holes being provided in the two exhaust pipes with each of the communicating holes of the said two exhaust pipes being disposed on one side with reference to the virtual flat surface passing the axis centers of the two exhaust pipes.

15. An exhaust device for a multi-cylinder engine comprising:

two exhaust passage members;

a communicating hole being provided in each of the two exhaust passage members, said two exhaust passage members being disposed to be spaced apart with the communicating holes of the two exhaust passage members being jointed with each other so as to communicate;

a base plate member having a through hole communicating with each of the communicating holes of said two exhaust passage members, wherein an entire outer circumferential area of each of said through holes is fixedly attached to said exhaust passage member wherein the outer circumferential area of each of the through holes overlaps the outer surface of the corresponding exhaust passage member;

a cover plate member, wherein edge portions on both sides are fixedly attached to at least either one of said base plate member or said exhaust passage member to surround the outer side of each of the through holes of said base plate member; and areas extending between said edge portions on both sides are fixedly attached to the front and rear edge portions of said base plate member between said two exhaust passage members.

16. The exhaust device for the multi-cylinder engine according to claim 15, wherein said base plate member is configured such that the entire area of the inner circumferential portion of said through hole is fixedly attached to the outer surface of said exhaust passage member.

17. The exhaust device for the multi-cylinder engine according to claim 15, wherein said cover plate member is fixedly attached only to said base plate member.

18. The exhaust device for the multi-cylinder engine according to claim 17, wherein the entire area of the outer circumferential portion of said cover plate member is formed to be adjustable according to the outer outlined shape of said base plate member, the entire area of the outer circumferential portion is fixedly attached so as to overlap the outside edge portion of said base plate member.

19. The exhaust device for the multi-cylinder engine according to claim 18, wherein said cover plate member is of a convex shape wherein the area from said outer circumferential portion to the center portion side swells outside.

20. The exhaust device for the multi-cylinder engine according to claim 18, wherein said base plate member is configured such that the area extending between said two exhaust passage members is formed to be recessed in a concave shape relative to the portion which is fixedly attached to said exhaust passage member.

* * * * *